US006840070B1

(12) United States Patent
Huang et al.

(10) Patent No.: US 6,840,070 B1
(45) Date of Patent: Jan. 11, 2005

(54) DOOR LOCK

(75) Inventors: Chao-Ming Huang, Kangshan Chen (TW); Chin-Sung Lee, Hunei Hsiang (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/618,719

(22) Filed: Jul. 15, 2003

(51) Int. Cl.[7] ..... E05B 9/08

(52) U.S. Cl. ..... 70/134; 70/370; 70/448; 70/451; 292/348; 292/350

(58) Field of Search ..... 70/134, 416, 370, 70/451, 466, 448, 449, DIG. 73; 292/348, 350, 336.3, 351, 352, 357, 358, DIG. 53

(56) References Cited

U.S. PATENT DOCUMENTS

| | | | | | |
|---|---|---|---|---|---|
| 97,654 | A | * | 12/1869 | Langford | 292/348 |
| 226,244 | A | * | 4/1880 | Parker | 292/357 |
| 1,519,678 | A | * | 12/1924 | Gates | 292/357 |
| 1,553,186 | A | * | 9/1925 | Rumberg | 292/347 |
| 1,611,753 | A | * | 12/1926 | Keeler et al. | 292/347 |
| 1,744,458 | A | * | 1/1930 | Ellingson | 292/350 |
| 1,799,253 | A | * | 4/1931 | Rogers | 292/350 |
| 1,847,797 | A | * | 3/1932 | Vernooy | 292/348 |
| 1,910,859 | A | * | 5/1933 | Rymer | 292/350 |
| 1,913,859 | A | * | 6/1933 | Sperduti | 70/333 R |
| 2,052,053 | A | * | 8/1936 | Menges | 292/357 |
| 2,296,020 | A | * | 9/1942 | Carter | 292/139 |
| 2,473,937 | A | * | 6/1949 | Cameron | 292/348 |
| 2,538,647 | A | * | 1/1951 | Lickteig | 70/381 |
| 2,702,204 | A | * | 2/1955 | Collier | 292/169.14 |
| 3,471,190 | A | * | 10/1969 | Turnbull et al. | 292/356 |
| 4,012,929 | A | * | 3/1977 | Solovieff | 70/134 |
| 4,047,408 | A | * | 9/1977 | Johns et al. | 70/129 |
| 4,728,133 | A | * | 3/1988 | Valley | 292/336.3 |
| 5,335,525 | A | * | 8/1994 | Solovieff | 70/370 |
| 5,556,144 | A | * | 9/1996 | Lin | 292/336.3 |
| 5,722,273 | A | * | 3/1998 | Lin et al. | 70/370 |
| 6,230,528 | B1 | * | 5/2001 | Don et al. | 70/370 |
| 2002/0096893 | A1 | * | 7/2002 | Wu | 292/347 |

FOREIGN PATENT DOCUMENTS

| | | | | |
|---|---|---|---|---|
| FR | 2378928 | * | 9/1978 | 70/134 |
| GB | 283318 | * | 1/1928 | 70/370 |
| GB | 354190 | * | 8/1931 | 292/348 |

* cited by examiner

*Primary Examiner*—Lloyd A. Gall
(74) *Attorney, Agent, or Firm*—Fei-Fei Chao; Bingham McCutchen LLP

(57) ABSTRACT

A door lock includes a cylinder with a core installed in a door. A flat finger is connected with the core. A latch is movably provided in a latch hole of the door and the flat finger extends through the latch. An inner cover is provided at an interior surface of the door opposite to the cylinder and has a plurality of sink holes defined therethrough for a plurality of first screws extending through the sink holes and engaged in the threaded holes. An outer cover is provided outside the inner cover to conceal the inner cover. A knob is provided outside the outer cover and has a hollow shaft extending through the outer cover and the inner cover and connected with the finger. Whereby, when the knob is turned, the latch can be extended or retracted to lock/unlock the door.

9 Claims, 8 Drawing Sheets

DOOR LOCK

BACKGROUND OF THE INVENTION

1. Field of the Invention

The present invention is related to a door lock, and more particularly to a door lock which is convenient to adjust for installing properly.

2. Description of Related Art

Referring to FIGS. 9 and 10, a conventional door lock is composed of a core (91) received in a cylinder (90), a latch (92), a guard plate (93), a back cover (94), and a knob (95).

The cylinder (90), located at an exterior surface of a door (97), is mounted in a lock bole (971) defined through the door (97). The core (91) is received in the cylinder (90). The latch (92) is received in a latch hole (972) laterally defined in the door (97) and in communication with the lock bole (971). A faceplate (96) is mounted at a sidewall of the door (97), and the latch (92) can extend out from the faceplate (96). The guard plate (93) is provided in the lock hole (971) and at an interior surface of the door (97). Two first screws (932), respectively extending through two first holes (931) in the guard plate (93), are engaged in the cylinder (90). The guard plate (93) is provided with a flat finger (911) extending through the latch (92) and into the core (91). The back cover (94) is mounted outside the guard plate (93) by two second screws (943) respectively extending through two second holes (942) in the back cover (94) and two third holes (933) in the guard plate (93) and engaged in the cylinder (90). The knob (95) is rotatably mounted in a fourth hole (941) in the back cover (94), and the finger (931) is received in the knob (95).

Therefore, turning the knob (95) can turn the core (91) and move the latch (92) by means of the finger (931) to lock/unlock the door.

However, it is difficult to install the lock properly in one time, and the movement of the latch (92) will not be smooth when it is in an improper status, so that adjustment is often needed and may involve repeated trial and error. Referring to FIG. 11, during the adjustment, because the first and second screws (932, 943) are engaged in the cylinder (90) through the guard plate (93) and the back cover (94) respectively, the second screws (943) must be first disengaged to detach the back cover (94), and then the first screws (932) can be loosened for adjusting the guard plate (93). Thus, it is very inconvenient to attempt to adjust the lock. Furthermore, the installed door lock does not have a nice appearance because heads of the second screws (943) exposed from the back cover (94) can be seen.

Therefore, the invention provides a door lock to mitigate and/or obviate the aforementioned problems.

SUMMARY OF THE INVENTION

The main objective of the invention is to provide a door lock which is convenient to adjust for proper installation.

Another objective of the invention is to provide a door lock with an attractive appearance.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
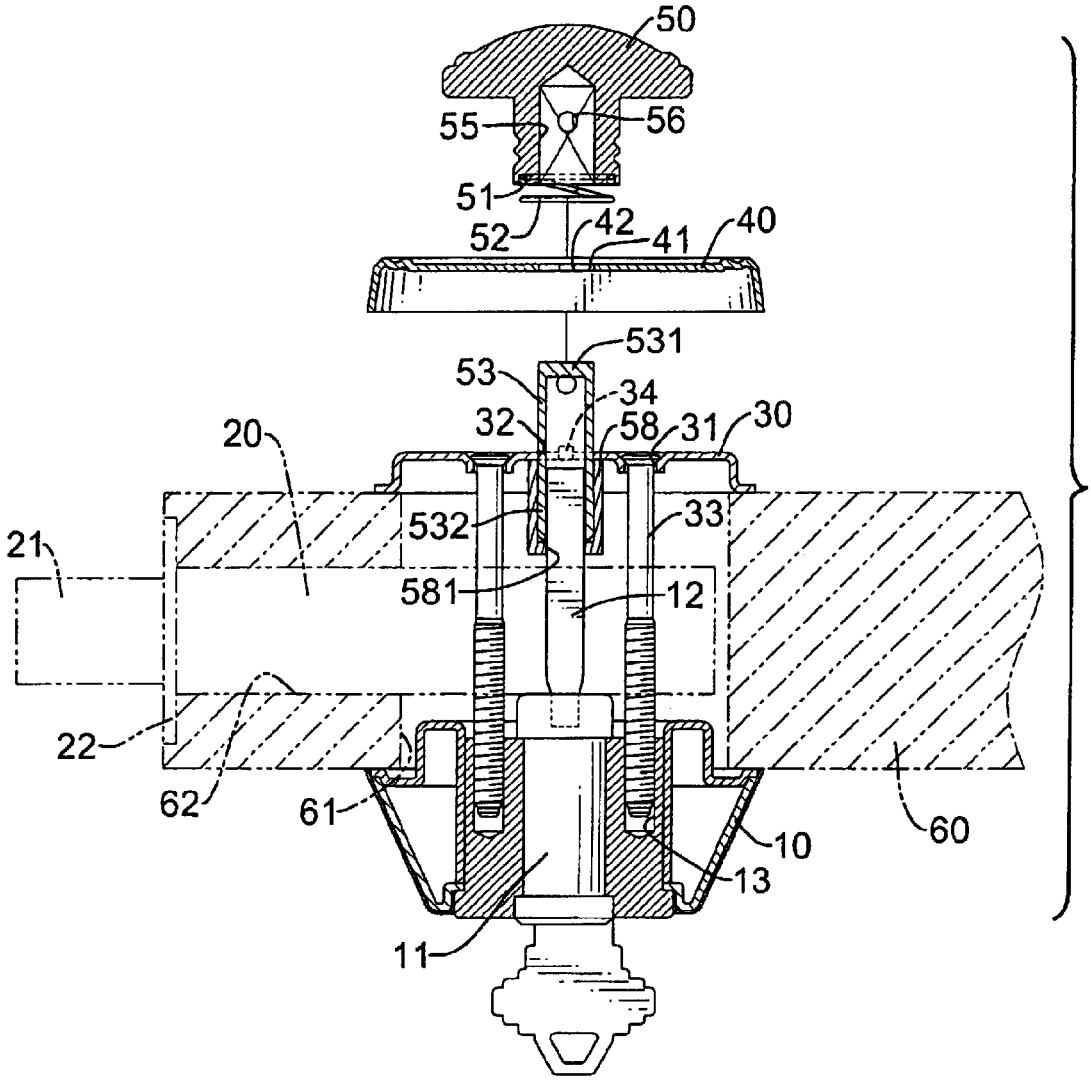
FIG. 1 is an exploded top sectional view of a first embodiment of a door lock in accordance with the invention.
Figure 2:
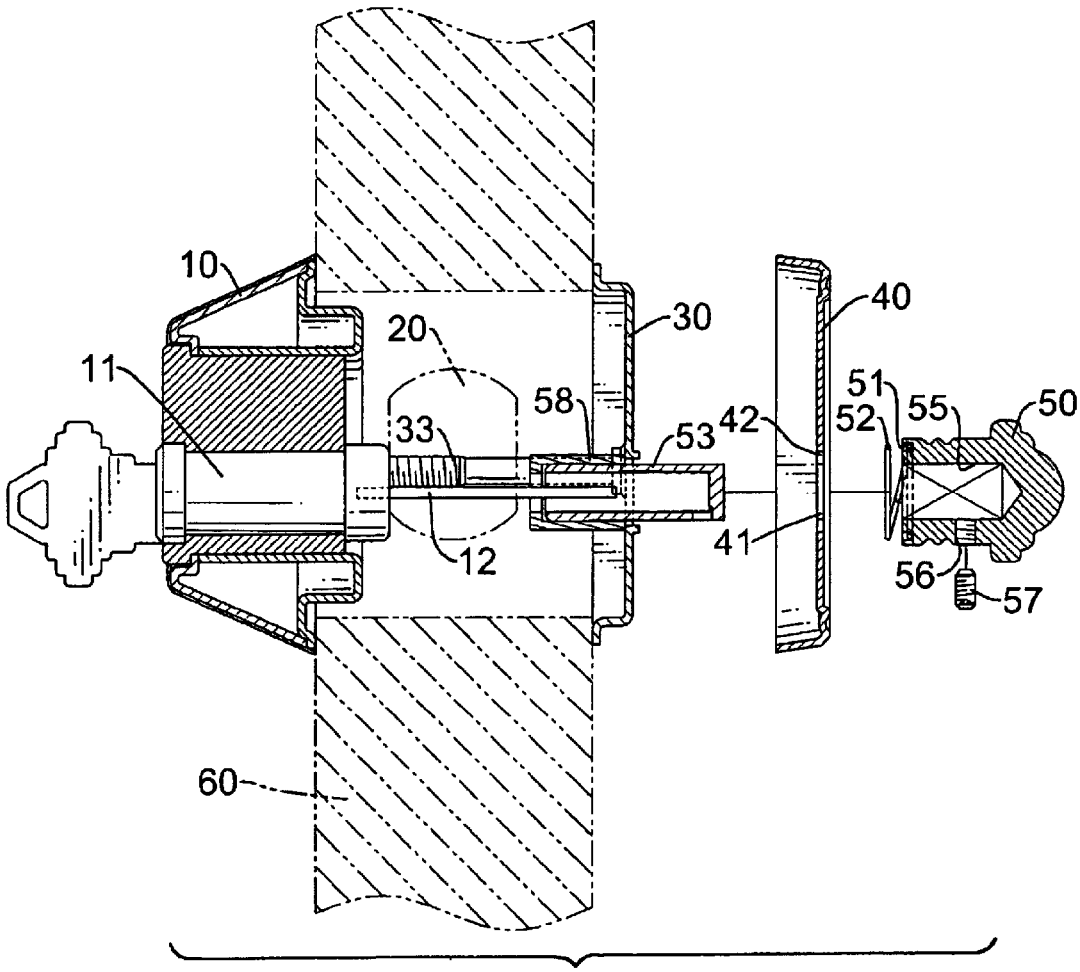
FIG. 2 is an exploded side sectional view of the door lock in FIG. 1.
Figure 4:
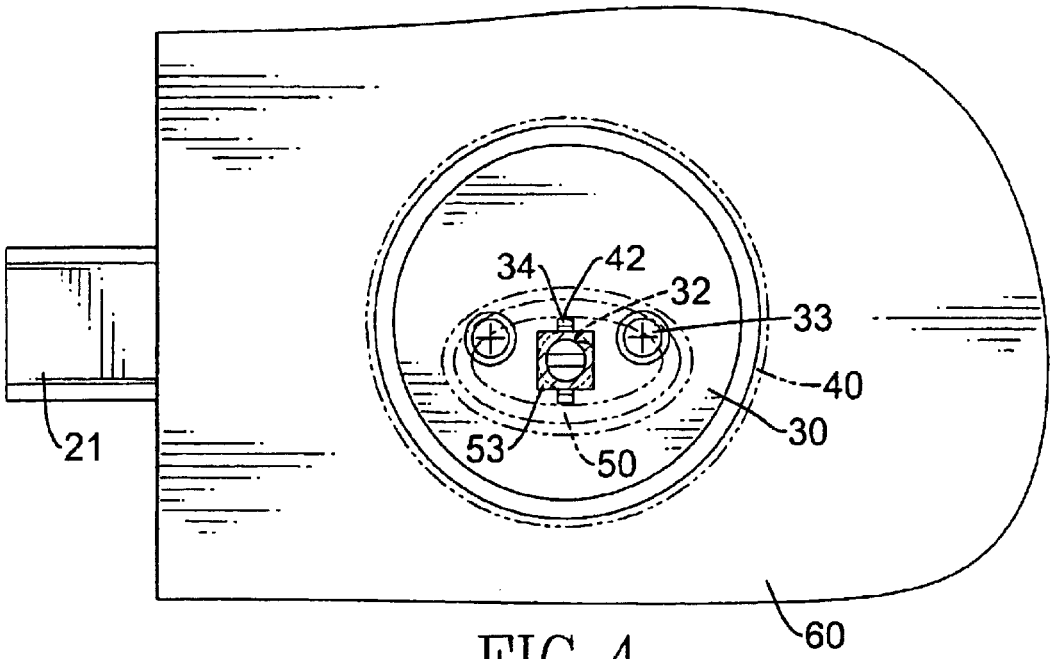
FIG. 4 is a front view of FIG. 3.
Figure 3:
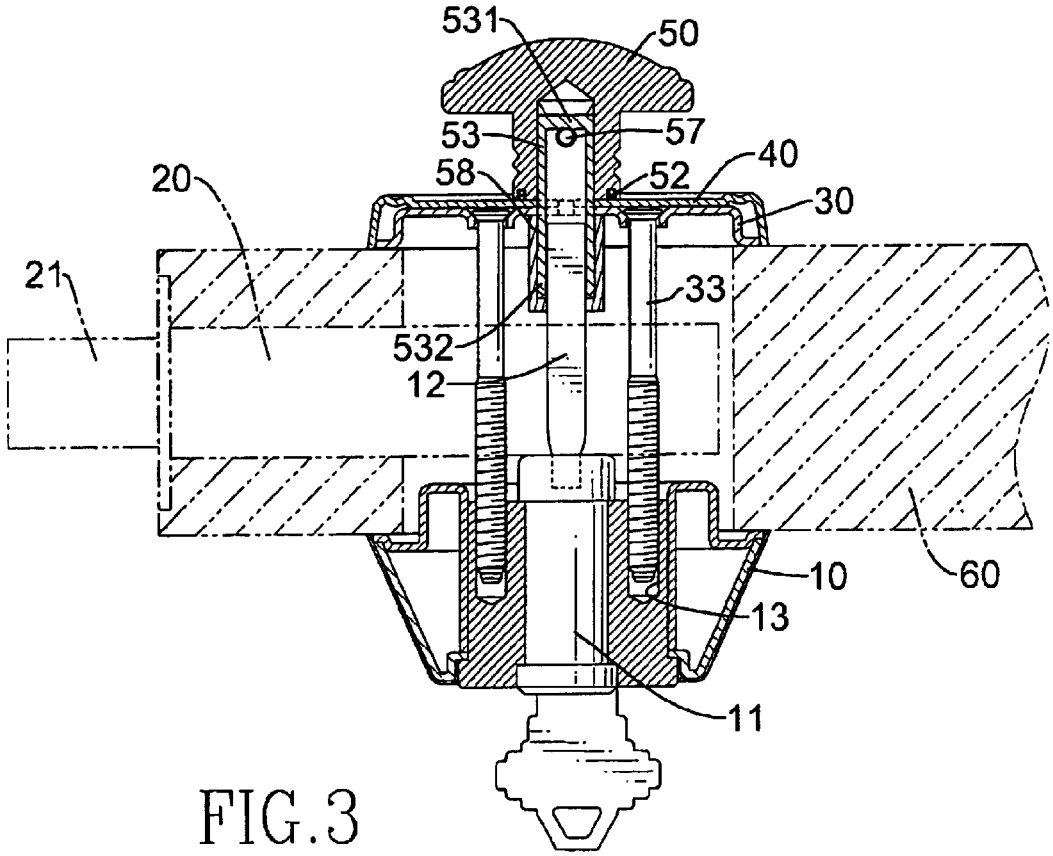
FIG. 3 is a top sectional view of the door lock in FIG. 1.

Referring to FIGS. 1–4, in a first embodiment in accordance with the present invention, a door lock has a cylinder (10) installed in a lock hole (61) of a door (60) and located at an exterior surface of the door (60). A core (11) with a key hole (not shown or numbered) is received in the cylinder (10). A flat finger (12) received in the lock hole (61) of the door (60) has a front end connected with the core (11). A plurality of threaded holes (13) is defined in the cylinder (10) around the core (11).

A latch (20) is movably received in a latch bole (62) laterally defined in the door (60), and the finger (12) extends through the latch (20). A faceplate (22) with a latch opening (not numbered) is mounted on a sidewall of the door (60), and a tongue (21) of the latch (20) can extend out of or retract into the latch opening when the core (11) and the finger (12) are turned.

An inner cover (30) is provided at an interior surface of the door (60) and has a plurality of sink holes (31) defined therethrough and corresponding to the threaded holes (13). Multiple first screws (33) respectively extend through the sink holes (31) and are engaged in the threaded holes (13) to fasten the inner cover on the door (60). The inner cover (30) further has a first central opening (32) defined therethrough.

An outer cover (40) is provided outside the inner cover (30) and has a second central opening (41) defined therethrough and aligned with the first central opening (32). Especially referring to FIGS. 2 and 4, the inner cover (30) has at least two lugs (34) formed around the first central opening (32) and respectively engaged in two apertures (42) defined around the second central opening (41) of the outer cover (40) to fasten the outer cover (40).

A knob (50) is provided outside the outer cover (40) and has a ringed recess (51) defined at an end facing the outer cover (40) and a shaft hole (55) longitudinally defined therein. A resilient member (52) is received in the recess (51) and abuts against the outer cover (40). A hollow shaft (53) extending through the first opening (32) and the second opening (41) has a rear end (531) positioned in the shaft hole (55) and an open front end (532) accessible for a rear end of the finger (12) to be inserted in the hollow shaft (53). A threaded aperture (56) is radially defined through the shaft hole (55), and a second screw (57) is engaged in the threaded aperture (56) to further fasten the shaft (53) in the shaft hole (55). Moreover, a sleeve (58) is provided outside the front end (532) of the shaft (53) and has an opening (581) for the finger (12) extending therethrough. Thus, when the knob (50) is turned, the finger (12) can be driven to rotate to move the latch (20).

In this embodiment, the cross sections of the shaft (53) and the shaft hole (55) are rectangular. It should be understood by those skilled in the art that the cross sections can be other polygonal shapes.

According to the embodiment described as above, it is easy to remove the outer cover (40) from the inner cover (30) because there is not a screw provided therebetween. Therefore, during assembling of the door lock, if the latch (22) or the finger (12) is not in the proper position, it is convenient to detach the outer cover (40) and loosen the first screws (33) for adjusting the latch (22) and the finger (12). Furthermore, the first screws (33) are concealed in the outer cover (40), so that the door lock has a nice appearance.

Figure 5:
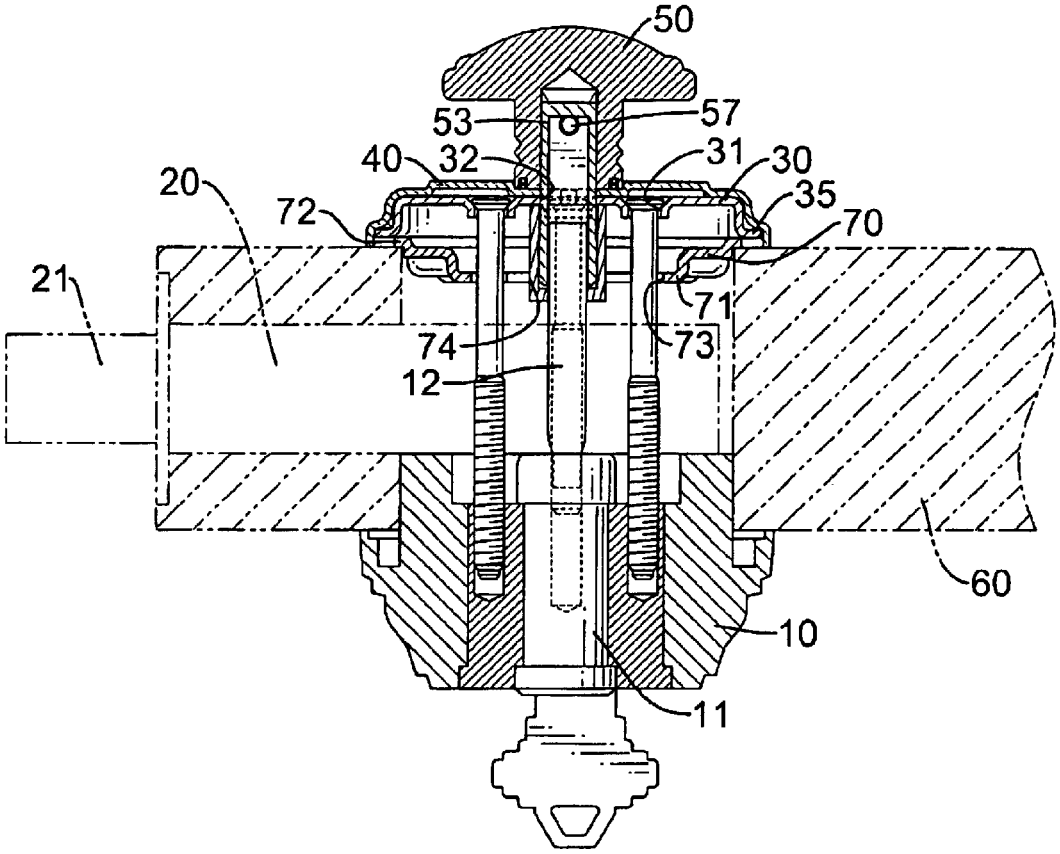
FIG. 5 is a top sectional view of a second embodiment in accordance with the invention.
Figure 6:
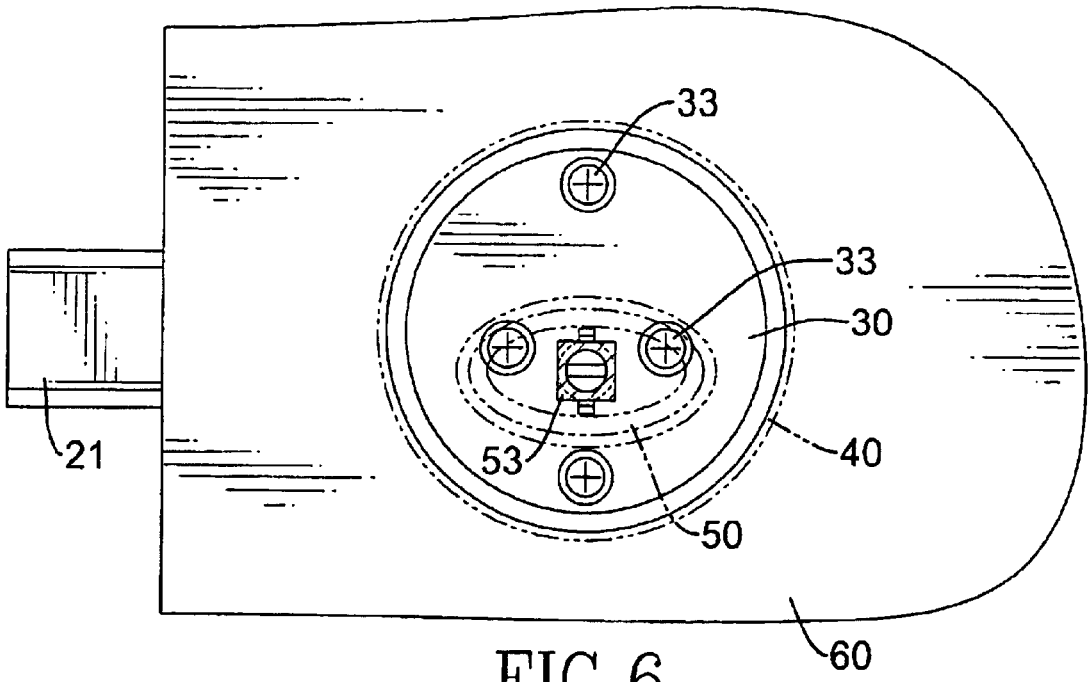
FIG. 6 is a front view of FIG. 5.

In another embodiment as shown in FIGS. 5 and 6, the door lock further has a guard plate (70) provided inside the inner cover (30). The guard plate (70) has a flange (71) received in the lock hole (61), and an edge (72) abutting a rim (35) of the inner cover (30). A plurality of first holes (73) corresponding to the sink holes (31) of the inner cover (30) is defined through the guard plate (70) and the first screws (33) respectively extend through the first holes (73). A third central hole (74) is defined through guard plate (70) and aligned with the first central hole (32) for the shaft (53) extending therethrough.

The door lock described as above also can be adjusted easily by means of simply removing the outer cover (40) and directly loosening the first screws (33).

Figure 7:
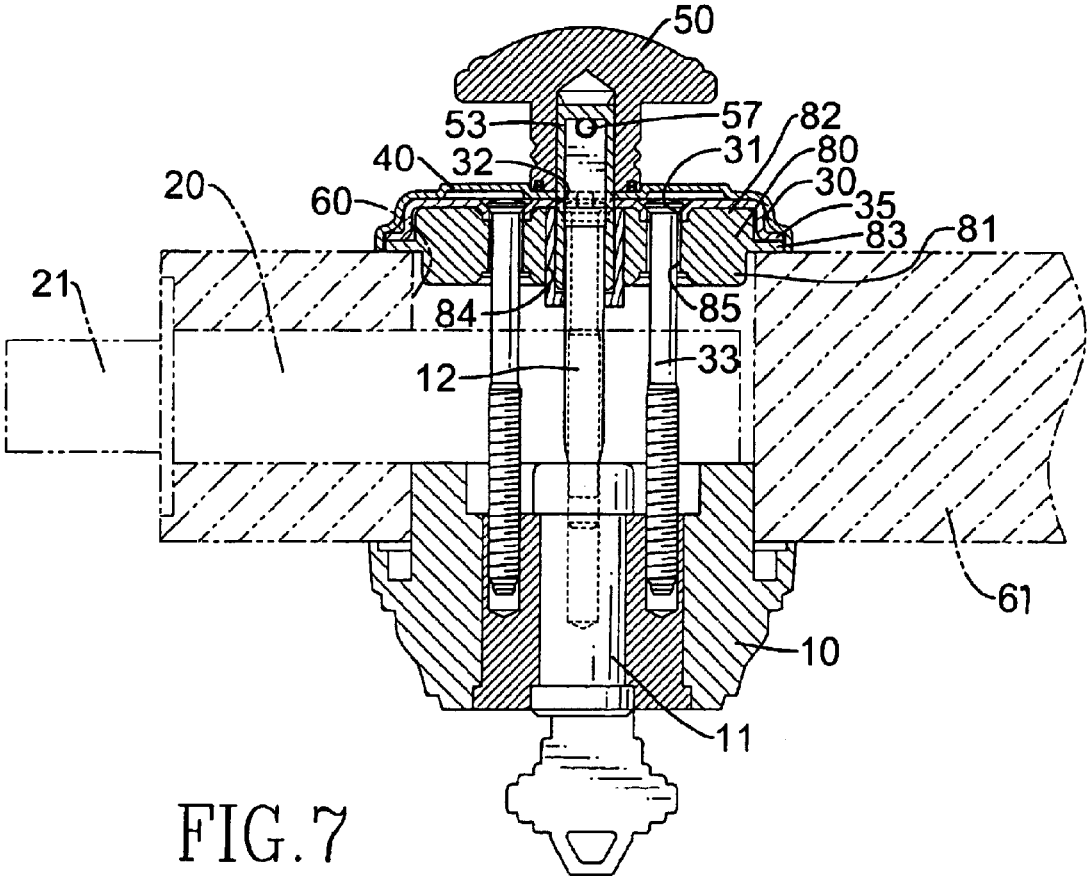
FIG. 7 is a top sectional view of a third embodiment in accordance with the invention.

Referring to FIG. 7, in a third embodiment of the invention, the door lock has a guard plug (80) provided inside the inner cover (30). The guard plug (80) has a first step (81) and a second step (82), wherein a diameter of the first step (81) is smaller than a diameter of the second step (82). The first step (81) is received in the lock hole (61), and the second step (82) is received in the inner cover (30). A shoulder (83) is formed between the first step (81) and the second step (82) and abuts the rim (35) of the inner cover (30). The guard plug (80) further has a plurality of second holes (85) respectively aligned with the sink holes (31) for the first screws (33) extending through the second holes (85). A fourth central hole (84) is defined through the guard plug (80) for the shaft (53) extending therethrough.

Figure 8:
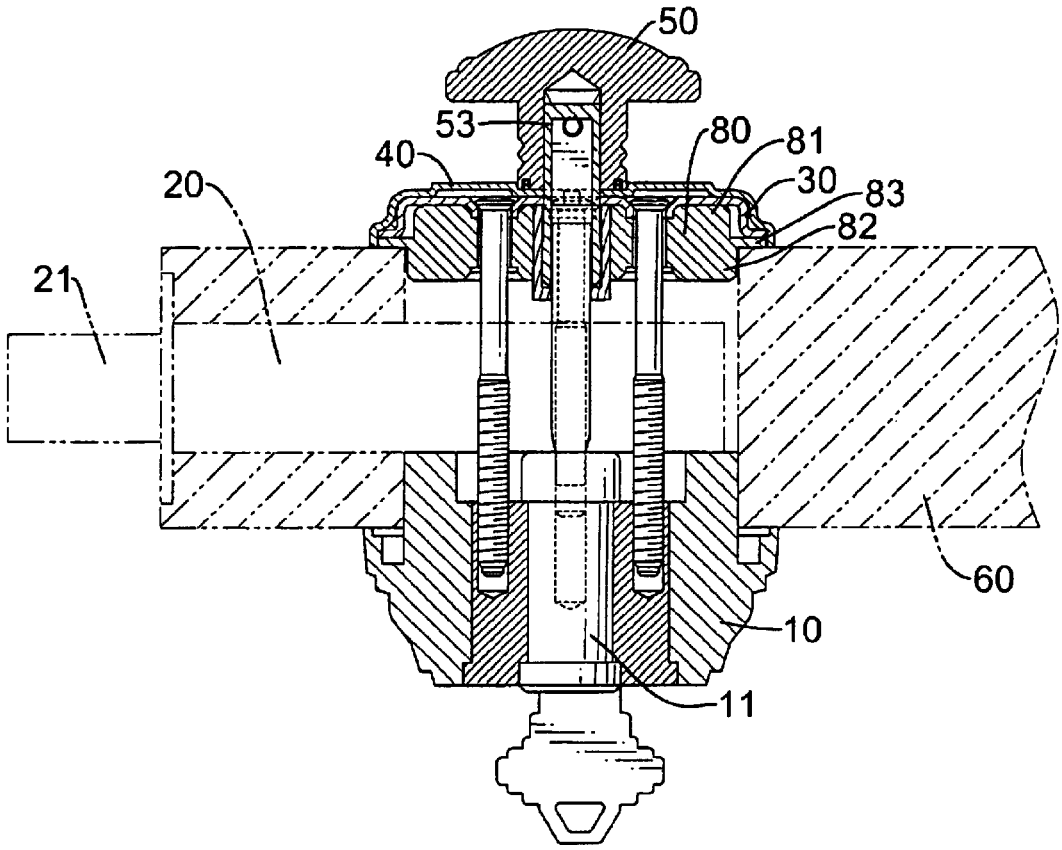
FIG. 8 is a top sectional view of the door lock in FIG. 7 assembled in another manner.
Figure 9:
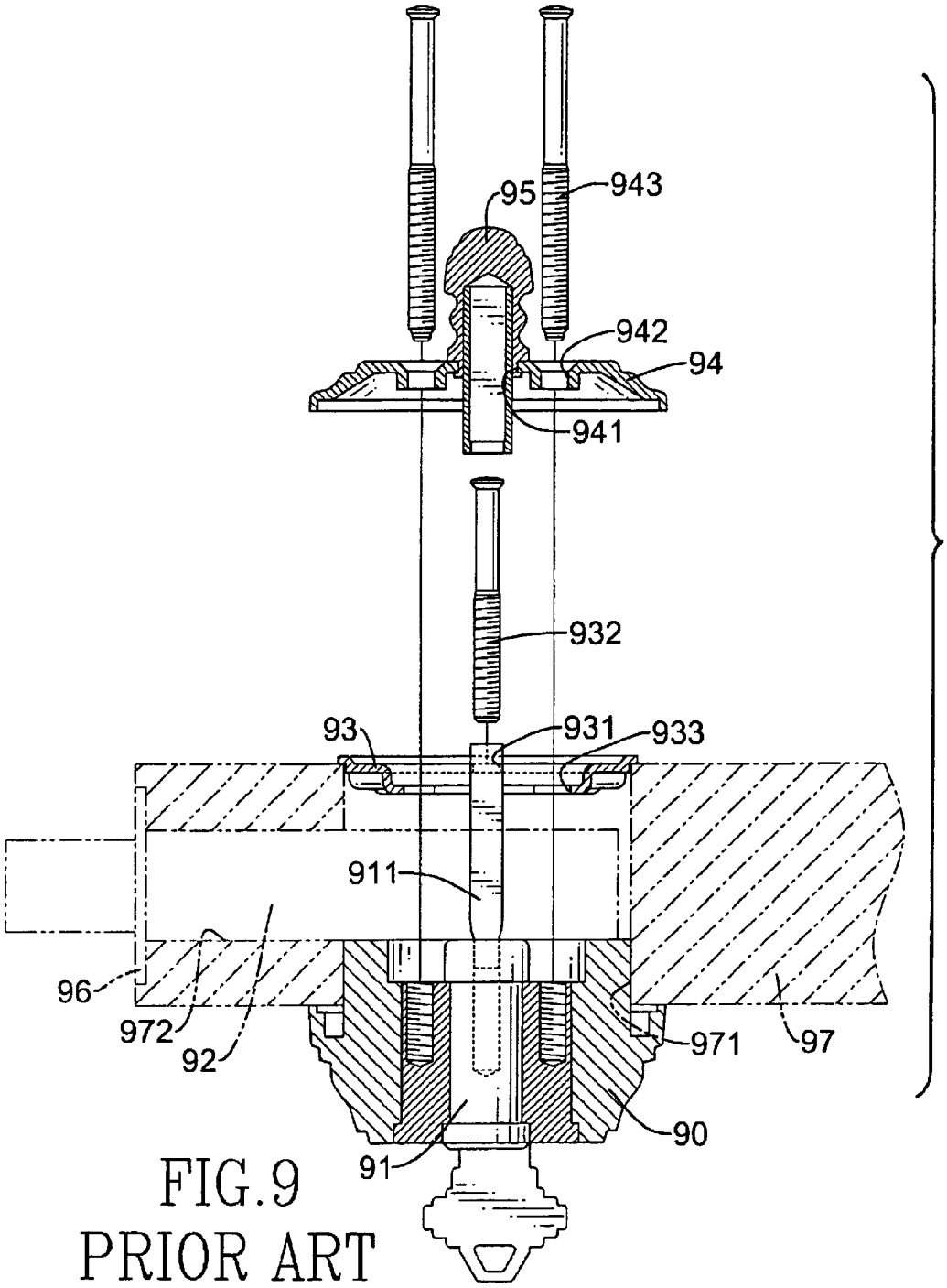
FIG.9 PRIOR ART
FIG. 9 is an exploded top view of a conventional door lock.
Figure 11:
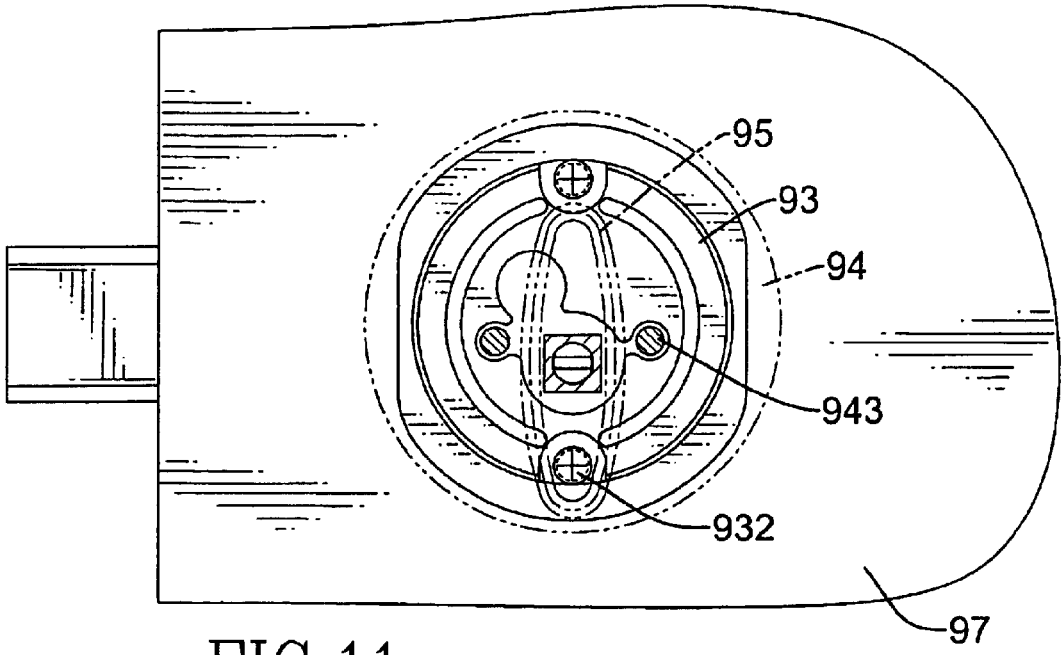
FIG.11 PRIOR ART
FIG. 11 is a front view of the conventional door lock in FIG. 9.
Figure 10:
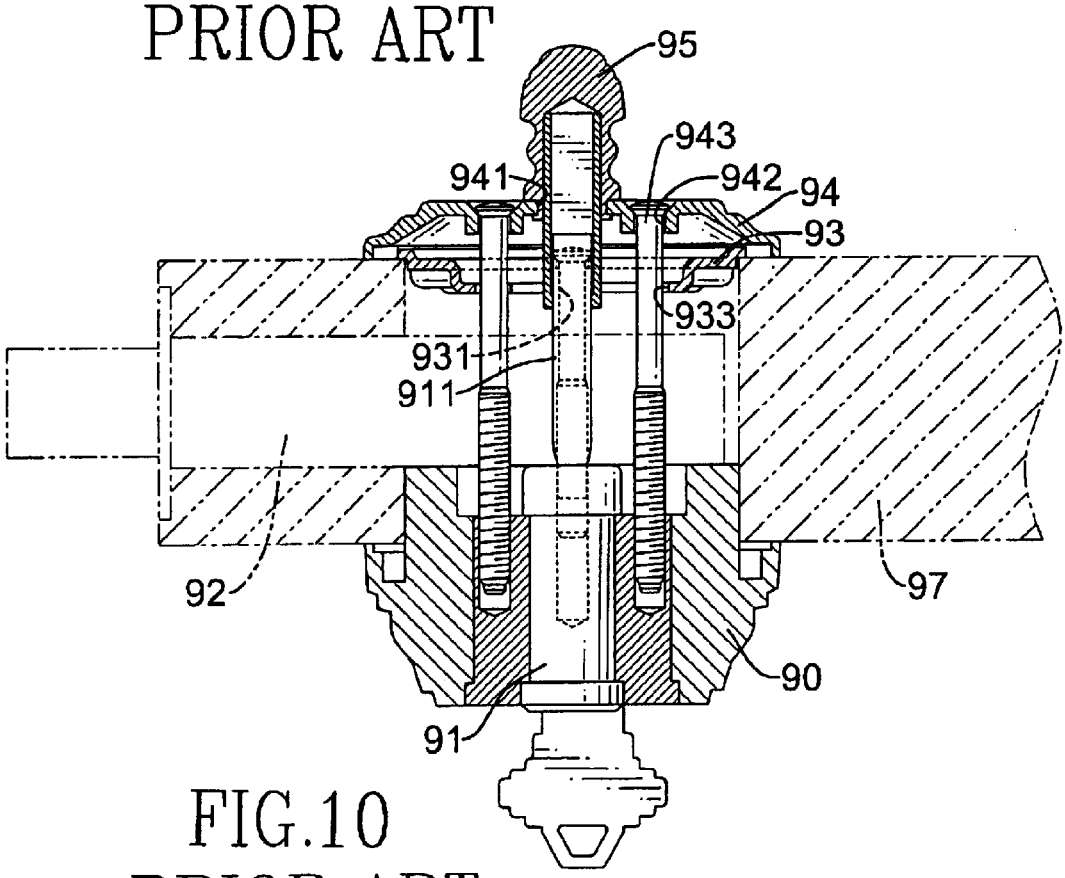
FIG.10 PRIOR ART
FIG. 10 is a top view of the conventional door lock in FIG. 9.

Referring to FIG. 8, for matching the lock hole (61) with a different diameter, the guard plate (80) can be arranged with the second step (82) received in the lock hole (61) and the first step (81) received in the inner cover (30).

By using the guard plug (80), the door lock can be installed in the door (60) more securely and have a high safety feature.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A door lock comprising:

a cylinder installed in a lock hole of a door and located at an exterior surface of the door, the cylinder having a core rotatably received therein, a flat finger connected with the core, and a plurality of threaded holes defined in the cylinder around the core;

a latch movably provided in a latch hole of the door and the flat finger extending through the latch;

an inner cover provided at an interior surface of the door opposite to the cylinder, the inner cover having a plurality of sink holes defined therethrough and corresponding to the threaded holes, a plurality of first screws extending through the sink holes and engaged in the threaded holes, and a first central opening defined therethrough;

an outer cover provided outside the inner cover and concealing the inner cover, the outer cover having a second central opening defined therethrough and aligned with the first central opening;

a knob provided outside the outer cover, the knob having a resilient member against the outer cover provided at an end facing the outer cover, and a hollow shaft extending through the first opening and the second opening and having a front end connected with the finger and a rear end engaged with the knob; and a guard plug provided inside the inner cover and having a first step and a second step, wherein a diameter of the first step is smaller than a diameter of the second step, and the first step and second step are selectively received in the lock hole and the inner cover, a shoulder formed between the first step and the second step and abutting the rim of the inner cover, a plurality of second holes respectively aligned with the sink holes for the first screws extending through the second holes, and a fourth central hole defined through the guard plug for the shaft extending therethrough, whereby, when the knob is turned, the latch can be extended or retracted to lock/unlock the door.

2. The door lock as claimed in claim 1 further comprising a guard plate provided inside the inner cover and having a flange received in the lock hole, an edge abutting a rim of the inner cover, a plurality of first holes corresponding to the sink holes of the inner cover defined through the guard plate and the first screws respectively extending through the first holes, a third central hole defined through guard plate and aligned with the first central opening for the shaft extending therethrough.

3. The door lock as claimed in claim 1, wherein the knob has a ringed recess defined at the end facing the outer cover and the resilient member is received in the recess.

4. The door lock as claimed in claim 1, wherein the inner cover has at least two lugs respectively engaged in at least two apertures of the outer cover to fasten the outer cover.

5. The door lock as claimed in claim 4, wherein the lugs are formed around the first central opening, and the apertures are defined around the second central opening.

6. The door lock as claimed in claim 1, wherein the knob further has a shaft hole longitudinally defined therein, and the rear end of the shaft is matingly positioned in the shaft hole.

7. The door lock as claimed in claim 6, wherein the cross sections of the shaft hole and the rear end of the shaft are polygonal.

8. The door lock as claimed in claim 6, wherein the knob further has a threaded aperture radially defined through the shaft hole, and a second screw engaged in the threaded aperture to fasten the shaft in the shaft hole.

9. The door lock as claimed in claim 1 further comprising a sleeve provided outside the front end of the shaft and having an opening for the finger extending therethrough.

* * * * *